United States Patent [19]

Eberle

[11] 4,397,456

[45] Aug. 9, 1983

[54] APPARATUS FOR SEPARATION OF A STACK OF FOLDED OR BOUND, MULTI-SHEET PRINTED PRODUCTS

[75] Inventor: Jürg Eberle, Hinwil, Switzerland

[73] Assignee: Ferag Ag, Hinwil, Switzerland

[21] Appl. No.: 258,542

[22] Filed: Apr. 28, 1981

[30] Foreign Application Priority Data

May 12, 1980 [CH] Switzerland ..... 3688/80

[51] Int. Cl.³ ..... B65H 3/04

[52] U.S. Cl. ..... 271/10; 271/35; 271/113; 271/165; 271/2

[58] Field of Search ..... 271/2, 4, 6, 10, 34, 271/113, 165, 166, 35

[56] References Cited

U.S. PATENT DOCUMENTS

| | | | |
|---|---|---|---|
| 1,854,221 | 4/1932 | Post | 271/2 |
| 2,049,513 | 8/1936 | Post | 271/113 |
| 2,554,577 | 5/1951 | Lauffer | 271/2 |
| 3,690,645 | 9/1972 | Reist | 271/113 X |

*Primary Examiner*—Richard A. Schacher
*Attorney, Agent, or Firm*—Werner W. Kleeman

[57] ABSTRACT

At one side of a stack of printed products or the like there are provided entrainment elements which are mounted at a revolving or orbiting driven chain or equivalent structure. Each entrainment element is inserted at one side of the momentarily lowermost printed product of the stack between the sheets of such printed product and comes into contact with the folding edge or spine of such printed product. By further moving the entrainment element the lowermost product is pulled out from beneath the stack while turning or rotating the same at the region of the product corner at which engages the entrainment element. The thus freely exposed region of the folding edge or spine of the lowermost product then comes to lie between two rolls or rollers of a product removal device, one of these removal rolls being driven. Both of these rolls pull the seized product out of the bottom of the stack in the product removal direction and place such upon two outfeed conveyor belts or bands. With this destacking apparatus it is possible to faultlessly process folded or bound printed products of appreciable thickness and without damaging such products.

23 Claims, 4 Drawing Figures

APPARATUS FOR SEPARATION OF A STACK OF FOLDED OR BOUND, MULTI-SHEET PRINTED PRODUCTS

BACKGROUND OF THE INVENTION

The present invention relates to a new and improved construction of apparatus for separation of a stack of folded or bound, multi-sheet printed products, especially newpapers and periodicals, in other words, singling or separating out individual product copies from the stack.

Generally speaking, the product singling apparatus of the present development is of the type comprising a product withdrawal device which engages in each instance at the lowermost product of the stack and withdraws such out of the stack. A retention device serves to retain the remaining products of the stack within the stack until they are singled out of the stack.

According to a prior art apparatus of this type, as exemplified for instance by Swiss Pat. No. 441,389 and the corresponding U.S. Pat. No. 3,446,498, there is provided a to-and-fro moving withdrawal apparatus which frictionally or force-lockingly engages by means of claws at the underside of the lowermost product within the stack and removes the thus seized product. The second lowermost product of the stack is fixedly retained by means of a hook engaging thereat, and therefore, is safeguarded against any undesirable entrainment during the withdrawal of the lowermost product. Apaart from there being required a complicated construction, this state-of-the-art equipment is afflicted with further drawbacks since there is present the danger of damaging the products by the claws of the withdrawal device and the retention hooks. With this prior art withdrawal device it is not possible to remove the momentary lowermost product of an upright stack from below the other products located thereover. Therefore, the stack must be tilted prior to the product singling or separation operation, so that the lowermost product comes to lie in a plane which encloses an acute angle with the horizontal. The products are then pulled out by the withdrawal device in such plane. This tilting of the stack necessitates that there be provided an appropriate mechanism for this purpose. Additionally, with the prior art destacking apparatus under discussion there is not insured for a faultless withdrawal of thick products or product copies.

Other constructions of apparatus for separating printed products or sheets of paper have been disclosed in U.S. Pat. Nos. 3,690,645; 4,127,262; 3,045,867; 3,785,523; and British Pat. Nos. 1,363,859 and 1,294,069.

SUMMARY OF THE INVENTION

Therefore, with the foregoing in mind it is a primary object of the present invention to provide a new and improved construction of stack separation apparatus which is not afflicted with the aforementioned drawbacks and shortcomings of the prior art constructions discussed in detail heretofore.

Another and more specific object of the present invention aims at overcoming the aforementioned drawbacks and, specifically, providing a product singling or separation apparatus of the previously mentioned type which is of relatively simple construction and design, possesses a high working capacity or output and which enables removing in a protective and disturbance-free manner printed products of different thickness and number of sheets from a product stack.

Yet a further significant object of the present invention aims at providing a new and improved construction of product destacking apparatus for the removal of single product copies from a product stack, which apparatus is relatively simple in construction and design, extremely reliable in operation, not readily subject to breakdown or malfunction and requires a minimum of maintenance and servicing.

Now in order to implement these and still further objects of the invention, which will become more readily apparent as the description proceeds the product singling or destacking apparatus of the present development is manifested by the features that the product withdrawal device contains at least one entrainment element which can be inserted at a side of the momentarily lowermost situated product and bounding the folding edge or spine of the product between the product sheets. This entrainment element comes into contact with the folding edge or spine of the product and thereafter is moved essentially in the product removal direction. The withdrawal device further comprises a product removal device which engages the lowermost product at the region of the folding edge or spine which has been pulled out from beneath the product stack by the action of the entrainment element.

The entrainment element which is inserted at one end into the momentarily lowermost printed product and impacts against the fold or folding edge or spine of the thus engaged printed product turns such product at the engaged side forwardly from below the product stack and places such at the effective or operative region of the product removal device. The product removal device, according to a particularly simple constructional embodiment, can be constituted by two rolls or rollers which receive therebetween the product, at least one of such rolls constituting a driven roll. The product removal device engages with the region of the fold edge or spine of the lowermost product which protrudes past the product stack and completely removes such product from below the stack.

An outfeed conveyor device, for instance constituted by at least one conveyor band or belt, is advantageously arranged after or downstream of the product removal device and serves to outfeed the withdrawn products. Preferably, the entrainment elements are driven so as to revolve or orbit along a path which contains a portion extending essentially in the product removal direction. This portion of the path of travel of the entrainment elements is located between two deflection locations, of which the deflection location situated at the start of such portion is arranged laterally of the stack. Due to the lateral arrangement of this one deflection location there is accomplished a faultless insertion of the entrainment element into the lowermost product or product copy of the stack.

To ensure that the entrainment element can readily again depart out of the engaged product and without damaging the same, the delivery or conveying velocity of the product removal device and the outfeed device are selected to be greater than the speed or velocity of movement of the entrainment element.

The operating speed of the destacking apparatus can be increased by providing a plurality of entrainment elements which, viewed with respect to their direction of movement, are attached at a mutual spacing from one another at a suitable traction element or equivalent structure.

It is advantageous to place the stack rearwardly at an inclination in relation to the removal device at the engagement side of the entrainment element. Due to this measure there is achieved the beneficial result that the pulled-out product can be removed with its leading fold or folding edge or spine extending approximately at right angles to the product removal or withdrawal direction.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
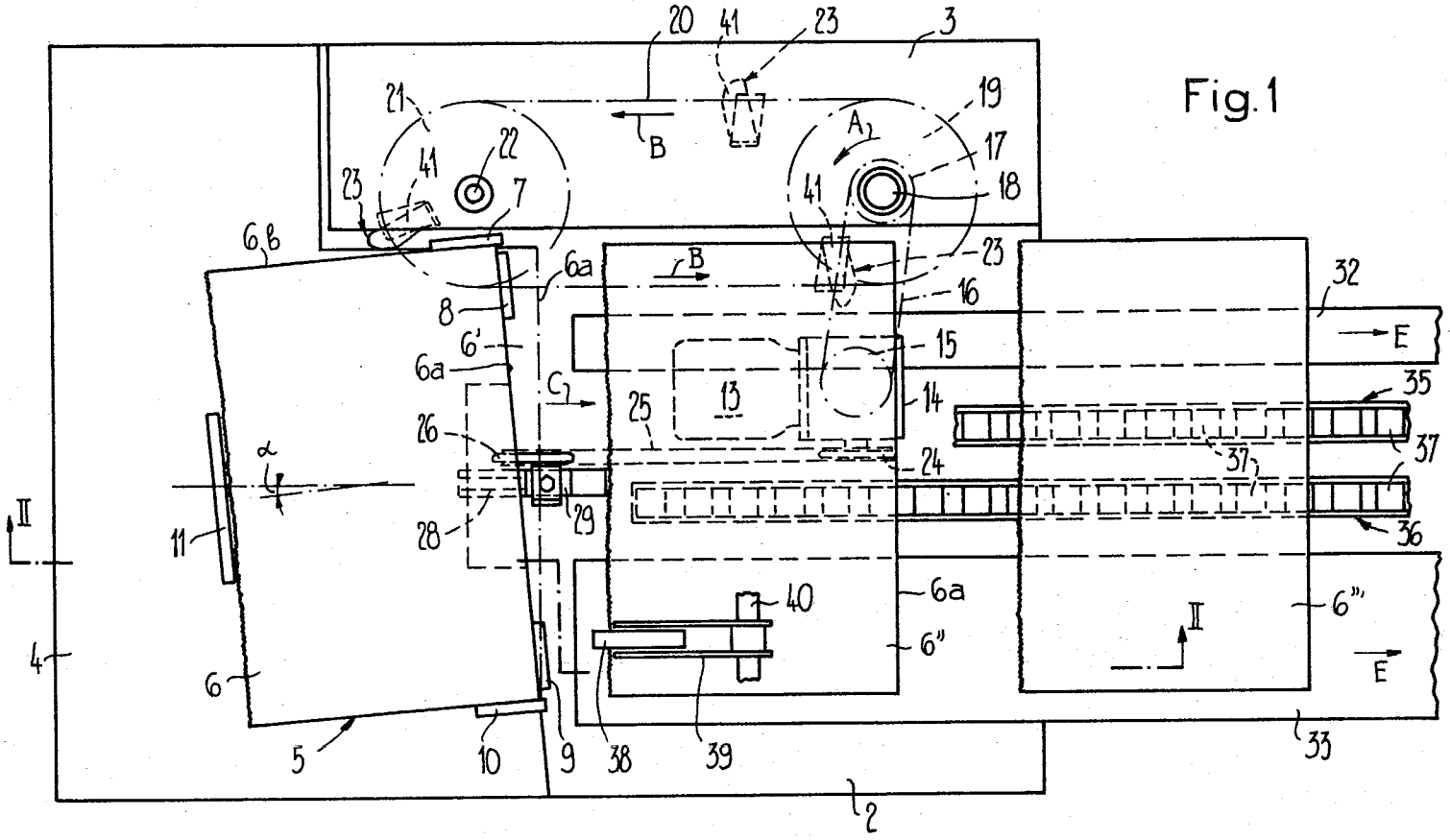
FIG. 1 is a top plan view of an apparatus for singling products from a stack of printed products according to the invention.
Figure 2:
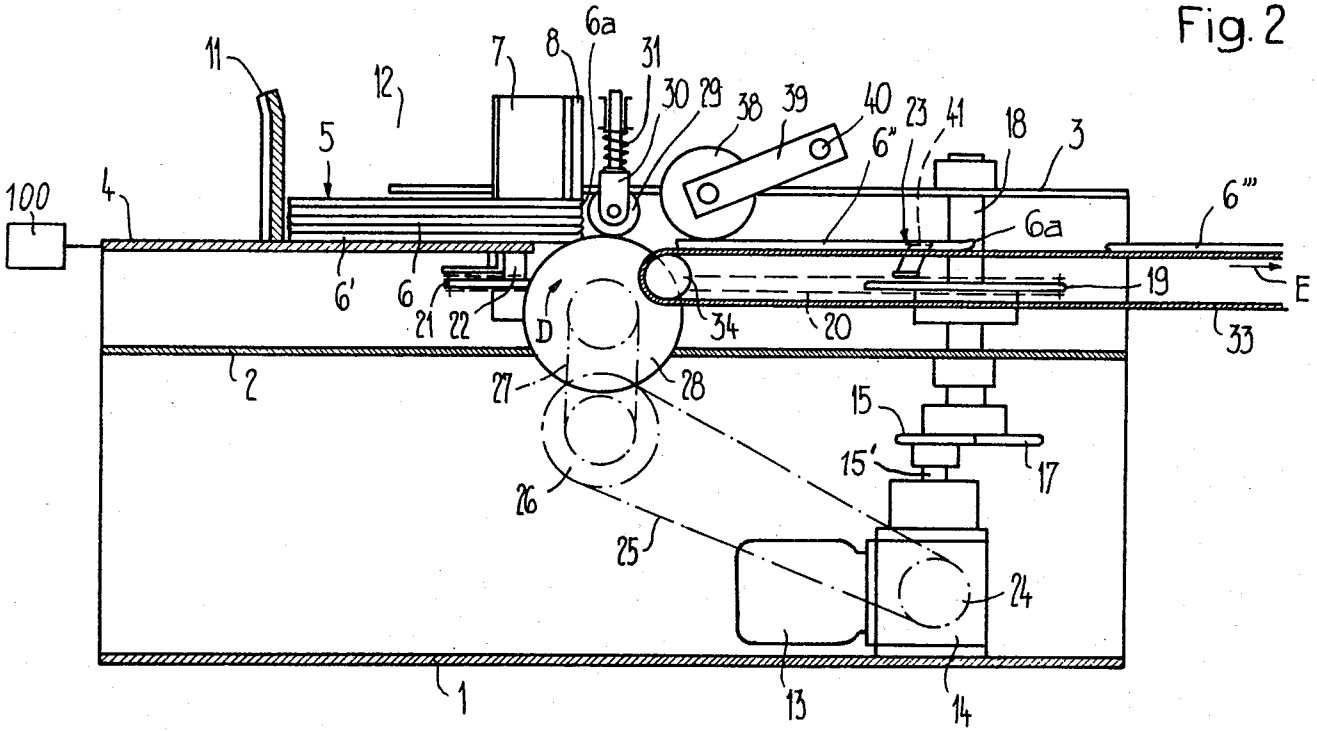
FIG. 2 is a cross-sectional view of the apparatus of FIG. 1, taken substantially along the lines II—II thereof.

Describing now the drawings, the product singling or destacking apparatus illustrated by way of example in FIGS. 1 and 2 will be seen to comprise a base plate 1 above which there are arranged at a mutual spacing from one another two bearing plates 2 and 3 as well as a support plate 4. The bearing plates or plate members 2 and 3 and the support plate or plate member 4 are supported in any convenient manner above the base plate 1, as best seen by referring to FIG. 2. The support plate 4 serves as a stack support for a stack 5 of printed products 6. The printed products 6, composed of a number of sheets, possess, in the embodiment under discussion and by way of illustration and not limitation, an engageable edge defining a transverse fold, so that there is formed a fold or folding edge 6*a*. As will be discussed more fully hereinafter, the folding edge need not be constituted solely by a transverse fold but also can be a longitudinal or lengthwise fold, or the spine of the product in the case of bound products. The printed products 6 are oriented in the same direction and repose upon one another, so that all of the fold or folding edges 6*a* of all of the products or product copies 6 are located at the same side of the product stack 5, as particularly evident by referring to FIG. 2. At the remaining three sides the printed products 6 are open. In the case of printed products, typically for instance newspapers, containing two folds, wherein the individual sheets are also folded lengthwise at the spine of the product, this lengthwise or longitudinal fold is located at the side of the printed products 6 designated by reference character 6*b*, as will be seen by reverting to FIG. 1.

At the region of the corners of the stack, which are formed by the folding edges 6*a* and the product sides merging thereat, there are provided abutment or contact rails 7, 8, 9 and 10, respectively, which protrude upwardly from the support plate 4. At the side opposite the folding edges 6*a* there is arranged a rear upright abutment or contact rail 11. These abutment or contact rails 7 to 11 define the stack space or compartment 12 for the reception of the printed product stack 5, as best seen from the illustration of FIG. 2. The printed products 6 bear by means of their folding edge 6*a* at the front abutment or contact rails 8 and 9, at their side edges at the lateral abutment or contact rails 7 and 10 and at their rear side at the abutment or contact rail 11. As also will be evident by inspecting FIG. 2 the rear abutment rail 11 lies upon the support plate 4. On the other hand, the abutment or contact rails 7, 8 and 9 terminate in spaced relationship from the support plate 4. This spacing essentially corresponds to the thickness of one printed product 6 or the like which is being processed, so that there is possible withdrawal or removal of the momentary lowermost product from the product stack 5, but the remaining products in the stack are retained in place. The lateral abutment rail or abutment means 10 likewise can terminate in spaced relationship from the support plate 4. However, it is also conceivable to permit the abutment rail 10, just as was the case for the abutment rail 11, to repose upon the support plate 4.

As will be particularly evident by referring to FIG. 1, the product stack 5 is turned about an axis which is disposed perpendicular to the support plate 4, and therefore is turned or rotated in the plane of the printed product 6 and positioned at an inclination or obliquely with respect to the product removal or withdrawal direction, indicated by the arrow C, for instance through an angle $\alpha$ mounting to about 5°. This inclined or slanted position of the stack 5, the purpose of which will be explained more fully hereinafter, is undertaken in such a manner that the corner of the stack 5 which is formed by the folding edges 6*a* and the therewith merging side edges 6*b* is rearwardly displaced or retracted.

Supported upon the base plate 1 is a drive motor 13 and a miter or bevel gear arrangement 14. The one drive shaft 15' of the miter or bevel gearing arrangement 14 carries a sprocket wheel or gear 15 which drives a second sprocket wheel or gear 17 by means of a chain 16. This sprocket wheel 17 or equivalent structure is rigidly connected for rotation with a shaft 18 which is mounted in the bearing plates 2 and 3. Keyed or otherwise appropriately affixed at the shaft 18 is a second sprocket wheel 19 over which there is trained a suitable traction element, here shown as a chain 20. This chain 20 travels over a second sprocket wheel 21 which is loosely seated upon an upright shaft 22 which is mounted in the bearing plate 3. The second sprocket wheel or gear 21 is located laterally of the stack 5. Secured at the chain 20 at a mutual spacing from one another are, for instance, three entrainment elements 23, the construction of which will be explained more fully hereinafter in conjunction with FIGS. 3 and 4. The miter gearing 14 drives a further sprocket wheel 24 which is drivingly connected by means of a chain 25 with a sprocket wheel 26. The rotational movement of the sprocket wheel 26 is transmitted by means of a chain or a belt 27 to a delivery or feed roll 28 arranged below the stack 5 and is mounted immediately forwardly of such stack 5. Cooperating with the feed roll 28 is a pressure or contact roll 29, also referred to as a counterpressure roll, which is arranged above the feed or delivery roll 28. This counter-pressure roll 29 is mounted to be freely rotatable in a bearing arrangement 30 upon which acts a compression spring 31 which presses the counter-pressure roll 29 toward or against the feed or delivery roll 28. In the event the inherent weight of the counter-pressure roll 29 is sufficiently large it is possible to dispense with the use of the compression or pressure spring 31 or equivalent structure. Both of the rolls 28 and 29 form a product removal device, the function of which will be explained more fully hereinafter. Thus, these rolls 28 and 29 also may be referred to as product removal rolls.

Viewed in the product removal or withdrawal direction C there merges with both of the removal rolls 28 and 29 two conveyor bands or belts 32 and 33 or equivalent structure. The conveyor belts 32 and 33 are arranged mutually parallel and in spaced relationship from one another, as will be seen by referring to FIGS. 1 and 2. These conveyor belts 32 and 33 are guided over deflection rolls 34 (only one such deflection roll has been shown in FIG. 2 to simplify the illustration) and are driven in any suitable manner, for instance by an appropriate drive or drive motor, so as to move in the direction of the arrow E. Between both of the conveyor bands or belts 32 and 33 and extending in parallelism therewith are two roll tracks 35 and 36 which are constituted by loosely mounted rolls or rollers 37. Both of the rolls or roller tracks 35 and 36 serve for supporting the printed products which are outfed by the conveyor bands or belts 32 and 33 between both of these conveyor belts.

Bearing upon the one conveyor belt or band 33, under the action of its inherent weight, is a pressure or contact roll 38 which is mounted to be freely rotatable in a bearing or support device 39. This bearing or support device or support means 39 together with the pressure or contact roll 38 is freely pivotable about a shaft 40 which only has been schematically indicated. This pressure or contact roll 38 serves for augmenting the outfeed operation and, under circumstances, could also be omitted. Furthermore, it is also conceivable to likewise arrange such a pressure or contact roll at the other conveyor belt 32.

Figure 3:
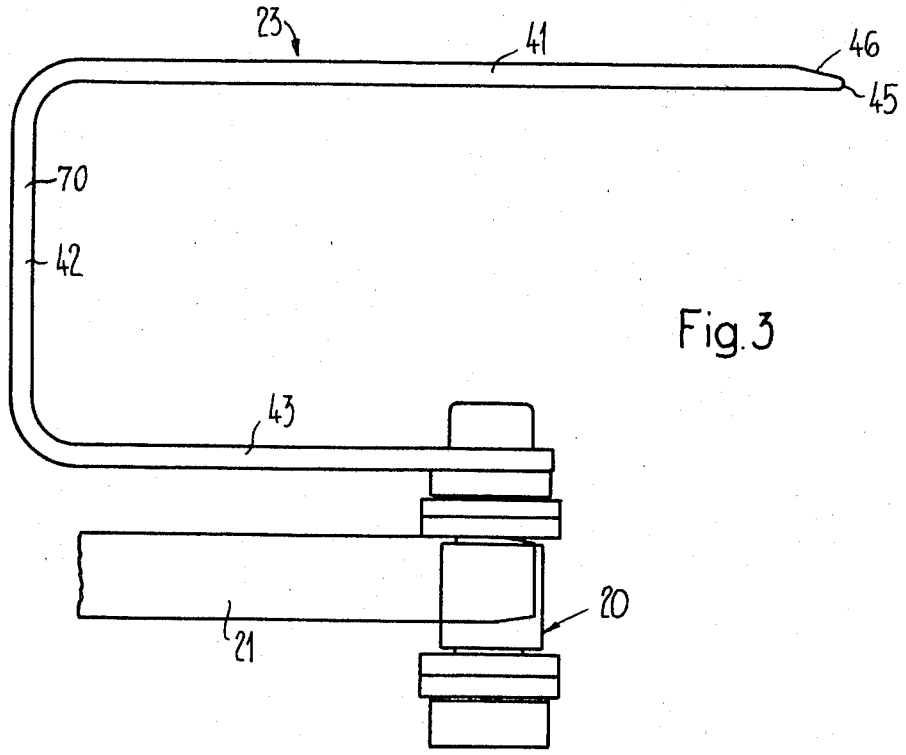
FIGS. 3 and 4 are respective side and top plan views of an exemplary embodiment of entrainment element used in the equipment of FIGS. 1 and 2 and shown on an enlarged scale.
Figure 4:
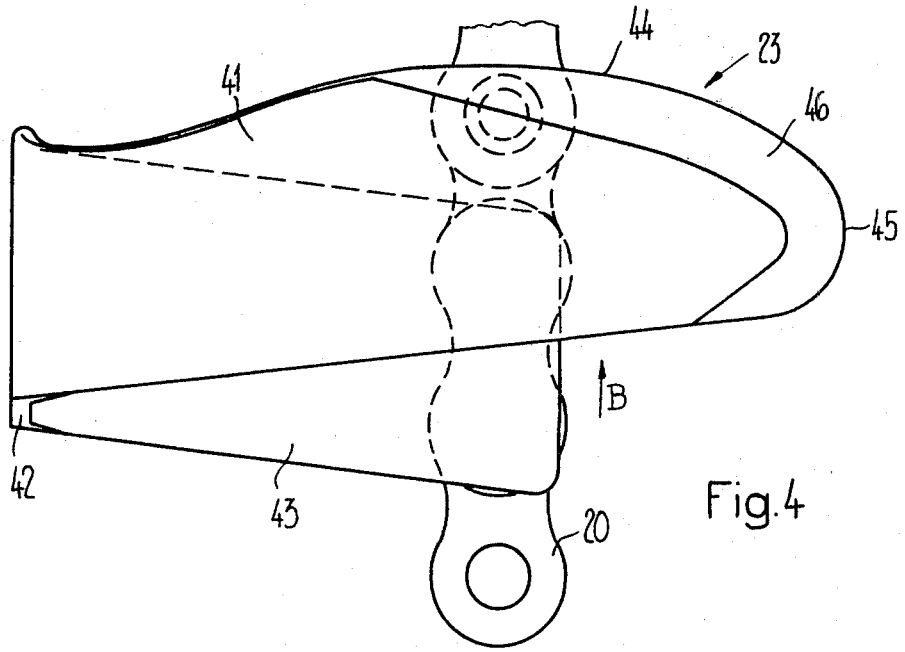

FIGS. 3 and 4 illustrate on an enlarged scale one of the entrainment elements 23. This entrainment element 23 is formed by the upper leg or leg member 41 of a reposing of lying, substantially U-shaped profile element, generally indicated by reference character 70. The upper leg member 41 is connected by means of a web or intermediate portion 42 with the lower leg member 43 of the U-shaped profile member or element 70. The lower leg or leg member 43, as best seen by referring to FIGS. 3 and 4, is fixedly connected, for instance bolted to the traction element, here shown as the chain 20. As will be evident from FIG. 4, the lengthwise axis of the lower leg 43 does not extend perpendicular to the chain 20 rather at an inclination or skewed with respect thereto. This measure serves to ensure for a faultless insertion of the longer upper leg member 41 into the printed products 6. The front edge or forward region 44 of the upper leg member 41, viewed in the direction of movement B of the traction element or chain 20 and the entrainment element 23, as such will be described more fully hereinafter, comes into contact with the folding or fold edge **6*a* of the printed products 6. The entrainment edge 44 merges at the narrow side of the leg member 41 into a rounded portion 45. In order to facilitate insertion of the entrainment element 23 into the printed products 6 and to safeguard against damaging such printed products, the upper leg member 41 possesses a wedge-shaped or bevelled surface 46 which descends towards the front edge 44 and which extends to the region of the rounded portion 45**.

Having now had the benefit of the foregoing detailed description of the exemplary embodiment of product singling or destacking apparatus its mode of operation will be considered and is as follows:

The drive motor 13 drives, by means of the miter or bevel gearing 14, the sprocket wheel 19 in the direction of the arrow A. Consequently, the chain 20 and along therewith the entrainment elements 23 are revolvingly driven in the direction of the arrow B. As will be readily recognized from FIG. 1 the entrainment elements 23 which travel around the sprocket wheel or gear 21 are deflected and arrive with the front edge 44 leading, at the side edge **6*b* of the lowermost printed product or product copy 6' or the like and each such entrainment element 23 is introduced at its front edge 44 between the sheets of such printed products. Due to the rounded portion 45 and the inclined or bevelled portion 46 this insertion of the entrainment element 23, i.e., the leg member 41, can be accomplished in a faultless manner and without damage to the printed product 6'. After the deflection or turning of the entrainment elements 23 has been completed the latter arrive at that portion of their path of travel which extends essentially parallel to the product removal or withdrawal direction C and which is located between both of the sprocket wheels 19 and 21. During the course of the deflection or turning movement the entrainment element 23 which has been inserted into the lowermost printed product 6' comes into contact with the folding or fold edge 6*a* and entrains such lowermost printed product 6' during its further movement. This entrainment of the printed product 6' causes a rotation or pivoting thereof, so that this lowermost printed product 6' is pulled out from beneath the stack 5 at the region of its product corner formed by the folding edge 6*a* and the therewith merging side edge 6*b*, as has been indicated by the phantom line shown product copy 6' in FIG. 1. Once the lowemost printed product 6' or other article which is being handled has been turned to such an extent that its fold edge 6*a* extends approximately at right angles to the product withdrawal direction C, then this product 6' is seized by the product removal or withdrawing device 28, 29 at the freely exposed region of its fold or folding edge 6*a*. The product 6' located between the feed or delivery roll 28 driven in the direction of the arrow D (FIG. 2) and the counterpressure roll 29 now is withdrawn from beneath the stack 5 in the product removal direction C and arrives at both of the conveyor belts 32 and 33. By virtue of the action of the pressure or contact roll 38 the printed product 6'' which has been pulled out from below the stack 5 is pressed against the conveyor belt or band 33, so that there is accomplished a faultless entrainment and outfeed of the singled or separated product 6''. The thus processed products are transported away by the conveyor belts 32 and 33, as the same has been illustrated in conjunction with the printed product 6'''**.

After seizing the product 6' which has been pulled by the entrainment element 23 through a certain distance from beneath and partially out of the stack 5, by the action of both of the product removal rolls 28 and 29, the entrainment element 23 need no longer exert any feed or conveying action at the printed product 6'. Now in order to bring the entrainment element 23 out of engagement with the folding edge **6*a*, the conveying speed of the product removal device 28, 29 is chosen to be greater than the speed of movement of the entrainment element 23. To allow for a non-problematic retraction of the entrainment element 23 out of the printed product 6''** at the region of the sprocket wheel or gear 19, also the conveying speed of both of the conveyor belts or bands 32 and 33 is chosen to be larger than the speed of movement of the entrainment elements 23. The entrainment elements 23 travelling about the sprocket wheel 19 are again deflected or turned and once again arrive back at the other sprocket wheel 21 where they are again introduced into the lowermost printed product of the product stack 5 in the manner previously described.

Since, as explained, the lowermost printed product 6 is turned in relation to the remaining products 6 within the stack 5 by the action of the entrainment element 23 which is effective at the relevant momentary lowermost printed product, this lowermost printed product 6′, at the time of engagement by the removal rolls 28 and 29, possesses a different orientation or position than the remaining products in the stack 5. The aforementioned inclined or skewed position of the stack 6 serves the purpose of ensuring that at the point of time of engagement of such printed product 6′ by the product removal device 28, 29 the folding edge 6*a* of such printed product 6′ will extend approximately at right angles to the product withdrawal direction C. If there is not used the aforementioned inclined or skewed position of the stack 5, then the outfed printed products will correspondingly assume an inclined position with respect to the product removal direction C.

By virtue of the withdrawal or separation of the printed products 6 by the entrainment elements 23 and the product removal device 28, 29 it is also possible to faultlessly remove products of appreciable thickness. The support plate 4 is preferably structured so as to be elevationally displaceable, for instance can be selectively positioned by the action of any suitable drive 100 or even manually, in order to thereby be able to accommodate the spacing between such support plate or member 4 and the entrainment elements 23 to the momentary thickness of the printed products 6 which are being processed. Since a plurality of entrainment elements 23 orbit or revolvingly travel there is possible an increased working capacity or output of the destacking apparatus than otherwise would be the case is there were only provided a single entrainment element. Of course, it is also conceivable to provide only one entrainment element. Due to the arrangement of the deflection location formed by the sprocket wheel 21 and which is located neighboring and alongside the stack 5 there is realized the advantage that the entrainment elements 23 can be faultlessly laterally introduced into the momentary lowermost printed product 6′ of the product stack 5.

Instead of using a single pair of removal rolls 28, 29 which engage approximately at the central region of the printed products, it would also be possible to use two or more pairs of such rolls or equivalent structure which are then distributed over the folding edge 6*a* of the printed products and in each case engage at the printed product which is in the process of being stripped from the stack. Although the described construction of product removal device in the form of one or more pairs of product removal rolls or rollers 28, 29 constitutes a particularly simple constructional solution, it is of course possible to design such product removal device differently, for instance in the form of grippers by way of example and not limitation.

It should be understood that with the described destacking apparatus it is possible to not only process printed products having a transverse fold but also bound products or articles. The inventive destacking apparatus is particularly suitable, although not exclusively, for the singling or separation of stacked newspapers or periodicals.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for the separation of a stack of folded or bound, multi-sheet printed products, especially newspapers and periodicals, comprising:

withdrawal means for engaging at the lowermost product of the stack and for pulling such out from below the stack;

means for retaining the remaining products within the stack while the lowermost product is being withdrawn from the stack;

said withdrawal means comprising at least one entrainment element;

means for moving said at least one entrainment element along a predetermined path of travel;

said entrainment element during its movement being first inserted at a side of the lowermost product between sheets of such product, which side merges with an engageable edge of the product, then said entrainment element coming to bear against said engageable edge of the product, and thereafter being movable essentially in the direction of a predetermined product removal direction, thereby pulling the lowermost product from below the stack at a region of the engageable edge; and said withdrawal means further including a product removal device which engages the lowermost product at the region of the engageable edge which has been pulled out from below the stack by the entrainment element and which moves the engaged product in said product removal direction.

2. The apparatus as defined in claim 1, wherein:

said engageable edge of the product defines a folding edge thereof.

3. The apparatus as defined in claim 1, wherein:

said predetermined path of travel of said at least one entrainment element is located in a plane which is essentially parallel to the products.

4. The apparatus as defined in claim 1, wherein:

said path of travel includes a portion extending essentially in the product removal direction;

said means for revolvingly driving said at least one entrainment element comprising means defining two deflection locations between which there is situated said portion of said path of travel; and one of said deflection locations being arranged at a starting region of said portion and being located laterally of the stack, in order to enable insertion of the entrainment element passing said one deflection location into the lowermost product.

5. The apparatus as defined in claim 1, wherein:

at least two of said entrainment elements are provided which, viewed with respect to their direction of movement, are arranged at a mutual spacing from one another.

6. The apparatus as defined in claim 1, wherein:

said at least one entrainment element is constituted by an elongate member extending transversely with respect to the direction of movement of the entrainment element;

a traction element at which there is attached said elongate member; and said elongate member having a leading side edge which comes into contact with the folding edge of the lowermost product engaged by the entrainment element.

7. The apparatus as defined in claim 6, wherein:

said entrainment element is provided at an end thereof intended to engage with the products with a rounded portion.

8. The apparatus as defined in claim 7, wherein:

said entrainment element is structured to have a substantially wedge-shaped configuration at an edge thereof intended to engage between the sheets of the lowermost product engaged by such entrainment element.

9. The apparatus as defined in claim 6, wherein:

said entrainment element is structured to have a substantially wedge-shaped configuration at an edge thereof intended to engage between the sheets of the lowermost product engaged by such entrainment element.

10. The apparatus as defined in claim 1, wherein:

said product removal device comprises at least one driven feed element arranged adjacent the stack and which can be brought into operative feed engagement with a freely exposed region of the engageable edge of the products.

11. The apparatus as defined in claim 10, wherein:

said feed element comprises a feed roll.

12. The apparatus as defined in claim 10, wherein:

said product removal device further includes a counter-pressure element operatively associated with said feed element and located opposite said feed element with respect to the product which is to be removed.

13. The apparatus as defined in claim 12, wherein:

said counter-pressure element comprises a pressure roll.

14. The apparatus as defined in claim 12, further including:

spring means for biasing said counter-pressure element towards said feed element.

15. The apparatus as defined in claim 1, further including:

product outfeed means arranged after said product removal device for conveying away the moved products.

16. The apparatus as defined in claim 15, wherein:

said product outfeed means comprises at least one conveyor belt.

17. The apparatus as defined in claim 15, wherein:

the conveying speed of the product removal device and the product outfeed means is greater than the speed of movement of said at least one entrainment element.

18. The apparatus as defined in claim 1, wherein:

said product retaining means comprise abutment elements which define a stack receiving compartment.

19. The apparatus as defined in claim 1, wherein:

the stack is arranged at an inclination and rearwardly with respect to the product removal device at the side of engagement of the entrainment element.

20. The apparatus as defined in claim 16, further including:

a counter-pressure element arranged above said at least one conveyor belt of the outfeed device and intended to come into contact with the removed products.

21. The apparatus as defined in claim 20, wherein:

said counter-pressure element comprises a pressure roll.

22. The apparatus as defined in claim 1, further including:

stack support means upon which bears said stack; and means for adjusting the position of said stack support means at a predetermined spacing with respect to the path of travel of the entrainment element.

23. The apparatus as defined in claim 1, wherein:

said engageable edge of the product defines a spine thereof.

* * * * *